United States Patent [19]

Goldstein et al.

[11] Patent Number: 4,590,842

[45] Date of Patent: May 27, 1986

[54] METHOD OF AND APPARATUS FOR ACCELERATING A PROJECTILE

[75] Inventors: Yeshayahu S. A. Goldstein, Gaithersburg; Derek A. Tidman, Silver Spring, both of Md.

[73] Assignee: GT-Devices, Alexandria, Va.

[21] Appl. No.: 471,215

[22] Filed: Mar. 1, 1983

[51] Int. Cl.[4] ..... F41F 1/00

[52] U.S. Cl. ..... 89/8; 376/102; 376/125

[58] Field of Search ..... 89/8, 7; 102/202, 291; 124/3, 56; 310/10–14; 376/105, 108, 128, 102; 313/231.31, 231.41, 359.1, 360.1, 362.1; 315/111.21, 111.41, 111.61, 111.81; 73/12

[56] References Cited

U.S. PATENT DOCUMENTS

| | | | |
|---|---|---|---|
| 16,568 | 2/1857 | Lyman | 89/8 |
| 200,740 | 2/1878 | Lyman | 89/8 |
| 310,382 | 1/1885 | Chichester | 89/8 |
| 484,010 | 10/1892 | Haskell | 89/8 |
| 484,011 | 10/1892 | Haskell | 89/8 |
| 1,298,447 | 3/1919 | Bradford | 89/8 |
| 1,320,111 | 10/1919 | Aydukovich | 89/8 |
| 1,421,435 | 7/1922 | Fauchon-Villeplee | 89/8 X |
| 2,360,217 | 10/1944 | Francis | 89/8 |
| 2,397,800 | 4/1946 | McArthur | 89/8 |
| 2,648,257 | 8/1953 | Stanley | 89/8 |
| 2,783,684 | 3/1957 | Yoler | 89/8 |
| 2,790,354 | 4/1957 | Yolit et al. | 89/8 |
| 2,870,675 | 1/1959 | Salisbury | 89/8 |
| 2,880,337 | 3/1959 | Langmuir et al. | 310/11 |
| 3,044,363 | 7/1962 | Musser | 89/8 |
| 3,059,149 | 10/1962 | Salisbury | 313/359.1 X |
| 3,069,344 | 12/1962 | Post et al. | 310/11 |
| 3,148,587 | 9/1964 | Melhart | 89/8 |
| 3,182,213 | 5/1965 | Rosa | 310/11 |
| 3,210,576 | 10/1965 | Brogan | 310/11 |
| 3,273,553 | 9/1966 | Doyle | 124/3 |
| 3,274,407 | 9/1966 | Brogan | 310/11 |
| 3,335,637 | 8/1967 | Null et al. | 89/8 |
| 3,357,306 | 12/1967 | Boyd et al. | 89/8 |
| 3,374,668 | 3/1968 | Godfrey | 89/8 |
| 3,418,878 | 12/1968 | Stricklin | 89/8 |
| 3,431,816 | 3/1969 | Dale | 89/8 |
| 3,457,826 | 7/1969 | Statt | 89/8 |
| 3,459,101 | 8/1969 | Scanlon Jr. et al. | 89/8 |
| 3,480,806 | 11/1969 | Berberich | 310/11 |
| 3,525,886 | 8/1970 | Radebold | 310/11 |
| 3,613,499 | 10/1971 | Hubbard | 89/8 |
| 3,712,227 | 1/1973 | Turner | 102/202 X |
| 3,854,097 | 12/1974 | Fletcher et al. | 89/8 |
| 3,916,761 | 11/1975 | Fletcher et al. | 89/8 |
| 3,929,119 | 12/1975 | Fletcher et al. | 89/8 |
| 3,939,816 | 2/1976 | Espy | 89/8 |
| 4,319,168 | 3/1982 | Kemeny | 89/8 |
| 4,343,223 | 8/1982 | Hawke et al. | 89/8 |
| 4,344,592 | 8/1982 | Constantinescu | 89/8 X |
| 4,429,612 | 2/1984 | Tidman et al. | 89/8 |
| 4,458,577 | 7/1984 | Fisher et al. | 89/8 |

FOREIGN PATENT DOCUMENTS

| | | | |
|---|---|---|---|
| 2447992 | 4/1976 | Fed. Rep. of Germany | 313/359.1 |
| 1033565 | 4/1953 | France . | |
| 448496 | 12/1936 | United Kingdom . | |

OTHER PUBLICATIONS

J. Applied Physics, vol. 51, No. 4, Apr. 1980 pp. 1975–1983.

*Primary Examiner*—David H. Brown
*Assistant Examiner*—John E. Griffiths
*Attorney, Agent, or Firm*—Lowe, King, Price & Becker

[57] ABSTRACT

A projectile is accelerated along a confined path by supplying a pulsed high pressure, high velocity plasma jet to the rear of the projectile as the projectile traverses the path. The jet enters the confined path at a non-zero angle relative to the projectile path. The pulse is derived from a dielectric capillary tube having an interior wall from which plasma forming material is ablated in response to a discharge voltage. The projectile can be accelerated in response to the kinetic energy in the plasma jet or in response to a pressure increase of gases in the confined path resulting from the heat added to the gases by the plasma.

41 Claims, 2 Drawing Figures

METHOD OF AND APPARATUS FOR ACCELERATING A PROJECTILE

TECHNICAL FIELD

The present invention relates generally to a method of and apparatus for accelerating a projectile and more particularly to accelerating a projectile along an enclosed path by supplying a high velocity, high pressure plasma jet behind the projectile from a location removed from a confined path through which the projectile is accelerated so the plasma enters the path at an acute, non-zero angle relative to the direction of projectile propagation.

BACKGROUND OF THE INVENTION

In our co-pending, commonly assigned application, Ser. No. 049,557, filed June 18, 1979, entitled "Method and Apparatus for Accelerating A Solid Mass", now U.S. Pat. No. 4,429,612, there is disclosed an apparatus for and method of accelerating masses ranging from fractions of a gram to kilograms to velocities in the range of approximately $10^2$ kilometers per second. The solid mass, preferably in the form of a projectile, is accelerated along a predetermined path by passing an electric discharge through a plasma layer adjacent the projectile surface layer. The discharge plasma is imploded against the projectile surface layers so the plasma arrives on a region of the peripheral projectile surface layer to impart force components to the projectile along and normal to the path, to thereby accelerate the projectile in free flight along the path. To achieve stable, free flight acceleration along the path, the plasma arrives at the region on opposite sides of the peripheral surface with substantially equal forces so the normal components are balanced and the projectile is accelerated by the axial components. The projectile region against which the forces act is a surface of revolution about a longitudinal axis of the plasma and the plasma has a circular inner imploding periphery at right angles to the axis when it arrives at the surface.

To accelerate the projectile to velocities in the stated range, the projectile must interact with the imploding plasma over a relatively long distance, such as approximately one meter to several hundreds of meters, or even greater distances if higher velocities are desired. To achieve stable acceleration over this considerable length, implosion of the plasma is synchronized with acceleration of the projectile along the path so arrival of the plasma on the peripheral projectile region is matched with movement of the projectile along the path. Preferably, the synchronism is obtained by initiating separate plasma discharges at spaced regions along the path. The discharges are timed so they are initiated at the spaced regions downstream of the projectile prior to the projectile arriving at the regions and impact on the surface of the projectile. The separate discharges may be initiated in response to a position detector for the projectile along the path.

It has been found that the method and apparatus disclosed in our previously mentioned co-pending application does not efficiently accelerate a projectile at relatively low velocities, i.e., less than 15 kilometers per second. It is, therefore, an object of the present invention to provide a new and improved apparatus for and method of accelerating a projectile from virtually at rest to a velocity that could range up to about 50 kilometers per second.

Another object of the invention is to provide a new and improved apparatus for and method of accelerating a projectile from virtually a rest condition to a velocity at which it can be efficiently accelerated by the prior art structure to a velocity in the range of $10^2$ kilometers per second.

DISCLOSURE OF THE INVENTION

In accordance with the present invention, a projectile is accelerated along a confined path having a longitudinal axis by supplying a pulsed high pressure, high velocity plasma jet to the path in such a manner that the plasma is applied to the rear of the projectile to accelerate the projectile as it traverses the path. The jet enters the confined path at a non-zero angle relative to the axis.

In one embodiment, the high pressure, high velocity plasma is derived by simultaneously supplying plural longitudinally propagating jets of the plasma streams to a common longitudinal location of the path. Each of the plasma jet streams is applied to the path at an acute, non-zero angle and has substantially the same pressure and velocity. In line additive components of the jet plasma streams combine behind the projectile in the confined path to accelerate the projectile.

Each of the plasma jet streams is derived by a separate structure, each including a tube having a passage with a longitudinal axis displaced from the confined path by the acute angle. The tube includes an interior passage defining dielectric wall including an ionizable substance. A voltage applied between spaced longitudinal regions of the passage causes the substance to be ablated and ionized to form the plasma inside of the tube. The passage is dimensioned as a capillary, i.e., the diametric distance across the passage is substantially less than the distance between the spaced regions, so that plasma formed therein has high velocity and high pressure to form each of the jet streams. One end of the passage has a flared orifice into the confined path to reduce tendency of the pulsed plasma jet to spread after it leaves the nozzle. The other end of the passage is blocked to prevent the flow of plasma through it. The passage has a longitudinal axis displaced from the confined path by the acute angle so that the jet stream associated with the structure propagates along the longitudinal axis of the passage and through the orifice into the confined path generally in the same direction as the projectile is being accelerated. Preferably, the acute angle is approximately 15°, to facilitate manufacture of the structure, as well as to minimize the transverse force components and maximize the in line force components.

In a preferred embodiment, the ionizable substance includes a carbon hydrogen composition, such as polyethylene. The hydrogen and carbon in the composition are ionized in response to the applied voltage to form the high velocity, high pressure plasma. A consumable dielectric wall containing hydrogen, such as polyethylene, is particularly advantageous because of the low molecular weight of the ionized substance.

A plurality of the jet applying structures are located at spaced longitudinal regions along the path. Activation of the jet at each of the spaced regions is synchronized so that at each of the longitudinal regions a pulse of the high pressure, high velocity plasma is applied to the rear of the projectile immediately after the projectile has traversed each of the longitudinal regions. To achieve the synchronization, movement of the projectile is detected at a point upstream of the region. In response to detection of the projectile passing through the upstream point, the jets are activated to apply the high pressure, high velocity pulse to a region downstream of the point. Preferably, the projectile is detected at a point immediately upstream of each of the regions, to activate the jet formation at each of the regions. It is to be understood, however, that in certain instances synchronization of the jets can be achieved on a preprogrammed basis.

The plasma capillary discharge ducts terminate in expansion nozzles that direct the plasma jets into the acceleration path. The nozzles provide plasma jet velocities of about 2 times the plasma sound speed inside the capillary discharge, i.e., convert the internal thermal energy stored in the plasma into directed flow kinetic energy of the plasma jets. These plasma jets should also have a flow velocity of approximately twice the projectile velocity to most efficiently accelerate the projectile by impinging on its rear surface. The projectile acceleration essentially occurs via the transfer of directed flow kinetic energy and momentum in the plasma jets to the projectile kinetic energy and momentum.

Expansion of the capillary discharge plasma out through an outwardly flared expansion nozzle also has the important effect of cooling the plasma so that it becomes a supersonic cool jet of plasma. This in turn reduces heat transfer to the path confining walls of the accelerator which reduces ablation of wall material so that the lifetime of the accelerator for repeated use is greatly increased.

For low velocities, less than about 10 kilometers per second, the projectile is formed as a surface of revolution having a diameter equal to the cross-sectional diameters of the confined path so that it is wall-confined. However, for velocities in excess of about 10 kilometers per second, the projectile preferably has a diameter slightly smaller than the cross-sectional diameter of the confined path, so that the projectile can be accelerated in free flight through the confined path, thereby reducing friction between the projectile and walls of the confined path. Because of this factor, the high pressure, high velocity plasma applied to the rear of the high velocity projectile, has a tendency to escape from around the projectile, forward of the projectile. The resulting, escaping gas forward of the projectile may cause false triggering of a detector for the position of the projectile, and can cause a pressure increase in front of the projectile, to reduce the projectile forward speed. To obviate such deleterious effects, the confined path in the high velocity region includes openings, e.g., in the form of slots or circular apertures, between each adjacent pair of longitudinal regions, to vent the high pressure, high velocity gas into a vacuum region surrounding the confined path. Preferably, the openings between each adjacent pair of longitudinal regions have a total area of at least twice the cross-sectional area of the interior of the confined path and the openings are located between each longitudinal region where the jet is injected and the detector immediately downstream of the region.

The acceleration region and plasma discharge ducts are evacuated to a sufficiently low vaccum pressure so that electrical breakdown of the discharges can be promptly obtained on application of a high voltage. The pressure is a function of the capillary dimensions (length and diameter) and the atomic species of the gas fill prior to firing.

In one embodiment the plasma jet streams are symmetrically disposed relative to the axis of the confined path so that transverse force components of the plasma jet streams relative to the axis of the confined path are substantially cancelled, but force components of the plasma jet streams in line with the axis are additive as the plasma jet streams combine behind the projectile.

In a second embodiment the plasma jet streams are derived from asymmetrically located jet nozzle means. The asymmetric jet nozzles supply jet streams that are assymetric with respect to the confined path axis at the locations where the jet streams enter the confined path. To provide in line additive components behind the projectile, firing of plasma occurs such that the projectile is downstream of the jet nozzle by a sufficient distance to enable the jet streams acting against the projectile to have no substantial net transverse force components, i.e. the transverse force components associated with the jet as it enters the confined path are smoothed so they have no net effect when forces from the jet impact against the rear of the projectile.

It is, accordingly, still another object of the present invention to provide a new and improved apparatus for and method of accelerating a projectile to a high velocity, wherein high velocity, high pressure plasma developed behind the projectile does not have a deleterious effect on the projectile as the plasma escapes around the front of the projectile.

Another object of the present invention is to provide a new and improved method of initiating plasma discharges from consumable wall, capillary plasma sources utilized for accelerating projectiles to high velocity.

A further object of the present invention is to provide a high velocity projectile accelerator including an accelerating expansion of plasma flow through nozzles so that the plasma thermal energy is more efficiently converted into jet kinetic energy while at the same time cooling the plasma in the jets so that reduced ablation of the accelerator walls adjacent the jets occurs, thereby increasing the lifetime of the device for repeated firing.

We are aware of Yoler et al, U.S. Pat. No. 2,790,354. In Yoler et al is disclosed a mass accelerator employing an enclosed wall structure that rapidly releases great quantities of light gas, preferably hydrogen, when subjected to heating by a current pulse of an electric arc. In response to release of the great quantities of gases from within the enclosure and behind a mass being accelerated, the pressure of propelling gases is increased, to propel the mass to a high velocity. In the structure of Yoler et al the plasma pressure is trapped in the barrel section behind the projectile so the acceleration is essentially the same as that in a conventional gas gun. Such a device would not be capable of accelerating the projectile to a speed in excess of the sound speed in the plasma, as is attained with the present invention. Further, the plasma sound speed in the prior art device decreases rapidly during the time while the projectile is accelerating after the current pulse has been completed due to contact between the hot plasma and the barrel walls. This has the deleterious effect of further limiting the maximum projectile velocity achievable in such a device to values substantially below 10 kilometers per second, as well as damaging the barrel wall via ablation which limits the device lifetime.

In contrast, the present invention initiates a plasma jet from a source remote from the projectile path. The jet acts against the rear of the projectile with a flow velocity of about two times the sound speed of the hot plasma produced during an energizing current pulse so that projectile velocities of up to about 50 kilometers per second are achievable with a higher efficiency since the nozzles convert plasma thermal energy into jet expansion through the nozzle. Expanding the jet through the nozzle enables the device to have a relatively long lifetime because of reduced erosion of walls coming into contact with the plasma. Further, the basic propulsion mechanism in the present invention involves a transfer of directed plasma jet kinetic energy and momentum to the projectile via collision between the plasma and the projectile. This is different from the enclosed plasma gas-gun pressure involved in the device disclosed by Yoler et al which is not suitable for achieving high projectile velocities.

An additional important advantage of the arrangement of the present system in which the plasma generating capillaries or ducts are situated oblique to the accelerator duct containing the projectile, is that the radius and length of the capillary discharge can be chosen as parameters independent of the dimensions of the barrel or bore through which the projectile propagates. Capillary discharges having a radius much less than the barrel radius are needed to achieve extremely hot plasmas via ohmic heating due to current flow through the capillary discharge.

The above and still further objects, features and advantages of the present invention will become apparent upon consideration of the following detailed description of several specific embodiments thereof, especially when taken in conjunction with the accompanying drawings.

DETAILED DESCRIPTION OF THE DRAWING

Figure 1:
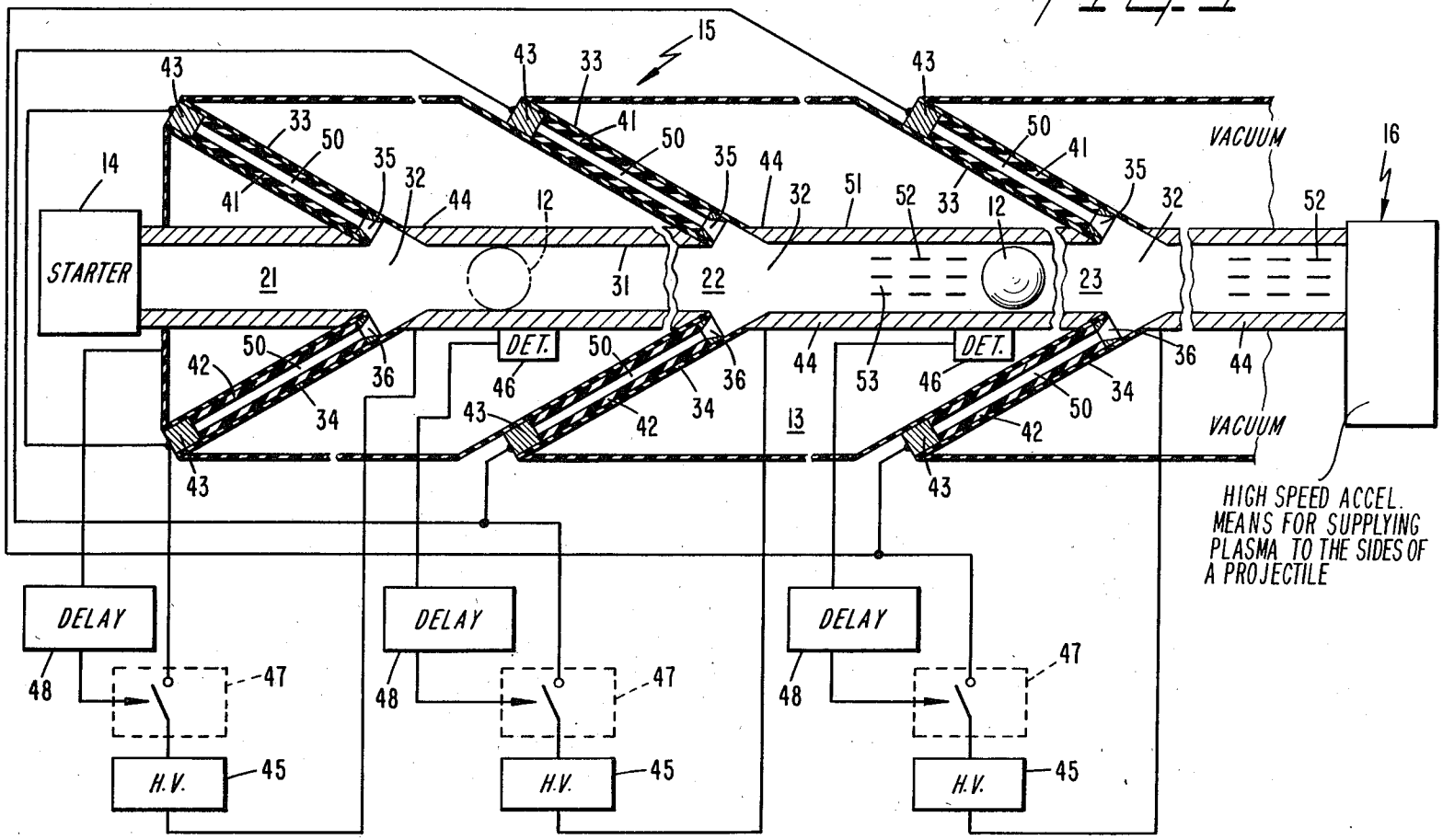
FIG. 1 is a schematic diagram of one preferred embodiment of the present invention.

Reference is now made to FIG. 1 of the drawing wherein there is illustrated an assembly for accelerating projectile 12 to extremely high velocity. The projectile is shown as spherical but could have various shapes. The assembly is located in vacuum chamber 13 and includes three separate sections, namely starter section 14, intermediate section 15 and final accelerator section 16 from which projectile 12 emerges at a very high velocity, such as $10^7$ centimeters per second. Starter section 14 can be a conventional gas gun, a chemical explosive or a plasma source similar to that disclosed in the previously mentioned Yoler et al patent. Downstream of starter 14 are three some-what similar, cascaded accelerating stages 21, 22 and 23 comprising section 15. Downstream of section 15 is section 16, preferably a series of high velocity plasma accelerating stages, such as disclosed in our commonly assigned application, Ser. No. 049,557, filed June 18, 1979, now U.S. Pat. No. 4,429,612. It is to be understood that intermediate section 15 is illustrated as including three stages for purposes of illustration only. In an actual embodiment, tens to hundreds of stages (depending on the application) would typically be included in intermediate section 15; high velocity accelerating section 16 may include as many as thousands of stages.

Projectile 12 is accelerated from rest by starter section 14 so that it enters intermediate section 15 at a velocity of a few (1–3) kilometers per second. In intermediate section 15, projectile 12 is accelerated to free flight to a velocity of approximately 50 kilometers per second in response to high pressure, high velocity plasmas directed to the rear of the projectile. In final accelerating section 16, projectile 12 is accelerated in free flight to a terminal velocity of approximately $10^2$ kilometers per second in response to imploding discharges from the several stages of the final section.

The high velocity plasmas directed to the rear of the projectile in section 15 and imploded onto the projectile in section 16 provide stable, high velocity forward, translatory motion for the projectile. As projectile 12 travels through the initial stages of section 15 it contacts side walls of the initial stages. As projectile 12 reaches higher speeds in the latter stages of section 15 and throughout its travel through section 16, the projectile propagates in free flight, a result achieved by appropriately dimensioning the walls of the latter stages of section 15 and by virtue of an implosion effect of plasma in section 16. Because projectile 12 propagates through the latter stages of section 15 and all of section 16 without wall contact, the high velocity frictional forces exerted on the projectile are minimized.

Each of sections 14, 15 and 16 has a common longitudinal axis along which the center of projectile 12 propagates, while the projectile is in free flight. Because all of the mechanical elements in sections 14, 15 and 16 are basically symmetrical with respect to the common longitudinal axis of the three sections equal forces are applied to the sides of projectile 12 to provide the stable forward motion thereof.

Because cascaded stages 21 and 22 are substantially the same, a description of stage 21 suffices for most of the remaining stages of section 15. Downstream stages 22 and 23 are the same as stage 21, except as described infra. Stage 21 includes a center cylindrical bore 31, coaxial with the common longitudinal axis of sections 14, 15 and 16. The walls of bore 31 define a confined path along which projectile 12 traverses.

Longitudinally propagating pulsed jets of an ionized gas, preferably containing hydrogen, are applied to a common longitudinal region 32 of the confined path formed by the wall of bore 31 by a source including relatively long and thin dielectric tubes 33 and 34 having longitudinal passages that form plasma capillary discharge ducts. The pulsed plasma jets flow to region 32 through outwardly flared orifices or nozzles 35 and 36 at the ends of tubes 33 and 34, respectively. Flared orifices 35 and 36 provide plasma jet velocities in region 32 about two times the sound velocity of the plasma in tubes 33 and 34, and approximately twice the velocity of projectile 12. Because the plasma expands as it propagates into region 32 from tubes 33 and 34 through flared orifices 35 and 36, the plasma is cooled so it becomes a supersonic, relatively cool plasma jet. Because the jet is cooled as it enters region 32, there is reduced wall ablation of the region and remainder of bore 31, to increase the life time of the accelerator. If material were ablated from the wall of bore 31, i.e. the projectile barrel, the supersonic plasma stream flowing through the barrel would be loaded with high atomic weight materials from the barrel. This material would reduce the plasma speed so that the plasma could not catch up with projectile 12 and push it. To assist in preventing ablation of the projectile barrel, nozzles 35 and 36 are preferably made of a refractory metal, having high thermal and electrical conductivity, e.g. an alloy of tungsten that can be machined. Also, tubes 33 are preferably made of a strong dielectric that can withstand the extreme pressure of the plasma jet; typical dielectrics for tube 33 are braided glass strands bonded by epoxy or Kevlar.

Tubes 33 and 34 are located with replaceable sleeves 41 and 42 so that when sufficient material has been ablated from the sleeves they are replaced, or are continuously replenished by a flow of insulating material into them in the time interval between discharges. The high pressure (typically several thousand atmosphere) plasma jets supplied by the source in tubes 33 and 34 to orifices 35 and 36 are derived by forming sleeves 41 and 42 of a carbon-hydrogen compound, such as polyethylene. The carbon-hydrogen compound in tubes 41 and 42 is ionized in response to a high voltage being applied to the compound, resulting in the liberation of hydrogen and carbon plasma. Polyethylene sleeves 41 and 42, respectively containing flared ends 35 and 36, are loaded into dielectric tubes 33 and 34 so that the exterior of each sleeve bears against the wall of the tube associated therewith and is held in place thereby.

Tubes 33 and 34 have a common angular oblique displacement from the longitudinal axis of bore 22. Thus, the longitudinal axes of tubes 33 and 34, as well as sleeves 41 and 42, are displaced by the same nonzero oblique angle from the longitudinal axis of bore 31. Tubes 33 and 34 extend from region 32 toward the rear of the assembly, i.e., toward starter 14. A typical acute angle between the longitudinal axis of bore 31 and each of tubes 33 and 34 is 15°, to facilitate manufacture of the tubes and to assure that the plasma jet pulses supplied by the tubes to bore 31 predominantly have forward velocity, in the direction projectile 12 is being accelerated.

Tubes 33 and 34 are shown as symmetrical with respect to the longitudinal axis of bore 31 and orifices 35 and 36 at the ends of the tubes adjacent the bore are longitudinally aligned at region 32 and the pressure and velocity of the plasma jets derived from tubes 33 and 34 are substantially the same. Thereby, force components of the jets passing through orifices 35 and 36 transverse to the longitudinal axis of bore 31 are substantially cancelled and force components of the jets in line with the axis of bore 31 are additive. More than two symmetrically arranged tubes can simultaneously supply more than two plasma jets to the same area. Also, it is to be understood that symmetry and transverse force component cancellation are not necessary for proper operation, but that an assymmetric arrangement can be provided, as described in connection with FIG. 2. The additive components of the pulsed plasma jets flowing from tubes 33 and 34 through flared orifices or nozzles 35 and 36 into region 32 combine behind projectile 12 to accelerate the projectile in free flight along the confined path defined by bore 31, away from starter section 14. Because of the angle of the longitudinal axes of the passages in tubes 33 and 34 relative to the longitudinal axis of bore 31, the in line force components from the plasma jets do not have a tendency to flow backwardly, toward starter section 14. Flared nozzles 33 and 36 overcome, to a certain extent, the tendency of the jets to spread after leaving tubes 33 and 34, i.e., the jets have a tendency to retain constant cross section. The angular relation between the axes of tubes 33 and 34 relative to bore 31 and the tendency of the jets to retain a constant cross section enable virtually all of the additive components of the jets to propagate toward and combine behind projectile 12, to accelerate the projectile along bore 31, away from starter 14.

Figure 2:
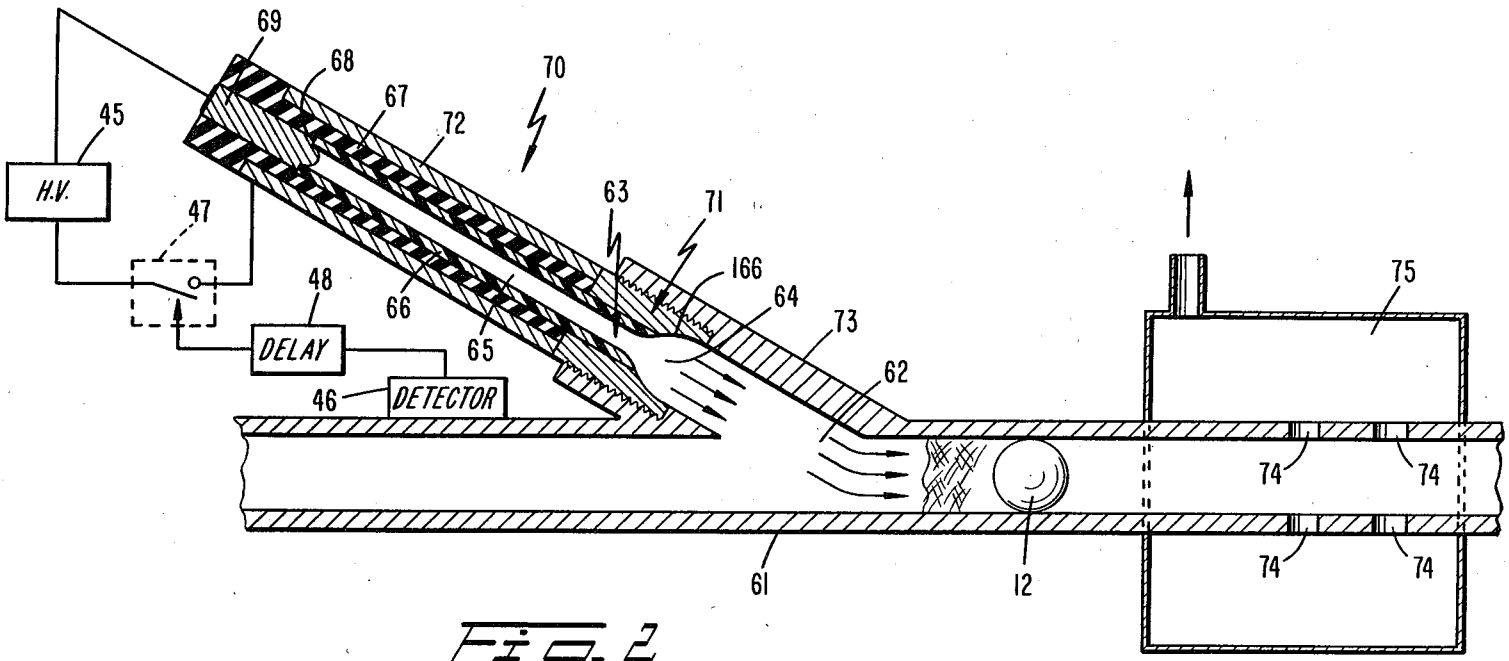
FIG. 2 is a schematic, cross sectional view of one section of a second embodiment of an accelerator in accordance with the present invention, wherein a single oblique discharge tube is included.

Because sleeves 41 and 42 are constructed identically, the following description is given in connection only with sleeve 41. Opposite ends of sleeve 41 are electrically connected to metal electrodes 43 and 44; electrode 44 is electrically connected to metallic nozzle 35. Electrodes 43 and 44 are selectively connected to opposite terminals of high voltage power supply 45. In response to the voltage of power supply 45 being applied across electrodes 43 and 44 as a result of closure of switch 47, electric breakdown occurs along the length of the inner wall defining the plasma capillary passage of sleeve 41. In the embodiment of FIGS. 1 and 2, the breakdown is facilitated because the interior capillary paths 50 are at a low vacuum pressure within chamber 13.

The breakdown between electrodes 43 and 44 is initiated along the inner wall of dielectric sleeve 41. Once breakdown along the inner wall of sleeve 41 occurs, plasma from the inner wall rapidly implodes radially of tube 33 to fill duct or capillary passage 50, defined by the volume surrounded by the inner diameter of sleeve 41. In response to the plasma filling duct 50, there is formed an electric discharge channel which is effectively a resistor between electrodes 43 and 44. The resistance of the discharge channel can be expressed as:

$$R=(l/\pi\alpha^2\sigma),$$

where

R = the resistance between electrodes 43 and 44, l = the length of sleeve 41 between electrodes 43 and 44, $\alpha$ = interior radius of sleeve 41, and $\sigma$ = is the conductivity of the plasma in the thus formed duct.

In response to current flowing through the plasma between electrodes 43 and 44, ohmic dissipation ($I^2R$) in the plasma transfers energy efficiently from a capacitor in high voltage supply 45 into the plasma. The resulting high plasma pressure causes plasma in duct 50 to flow longitudinally of the passage, rapidly out of the nozzle formed by flared orifice 35 at the end of tube 33; the other end of the passage is blocked by electrode 43 to prevent the flow of plasma through it. Simultaneously, radiation emission and thermal conduction transport energy from the plasma in duct 50 to the wall of sleeve 41, to ablate additional plasma from the wall of sleeve 41, to replace plasma ejected through orifice 35. Thereby, material on the interior wall of sleeve 41 is consumed as fuel and ejected as plasma in response to the electric energy provided by high voltage supply 45 when switch 47 is initially closed.

The length l, radius $\alpha$, and atomic species (hydrogen and carbon) in the plasma in sleeve 41 are chosen such that the discharge resistance R exceeds the sum of the resistance of high voltage source 45 and the wires connected between the high voltage source and electrodes 43 and 44. Thereby, energy is efficiently transferred from a capacitor in high voltage supply 45 to the plasma in a relatively short interval, determined by the discharge resistance, as well as inductance and capacitance of high voltage supply 45. Internal energy and the pressure in the plasma formed in tube 33 are converted into kinetic streaming energy by the nozzle formed by flared orifice 35. Typical flow speeds of the pulsed plasma jets supplied through orifice 35 to bore 31 exceed the sound speed of the plasma in tube 33 by a factor of approximately two, i.e., several times, and generally are in the range of several kilometers per second up to about 200 kilometers per second for sleeves 41 formed of polyethylene.

In one preferred, actually manufactured configuration, the passage in polyethylene sleeve 41 has a circular cross section with a radius of 0.15 cm and a length of 10 cm between electrodes 43 and 44 to form a capillary duct. (This is typical of the requirement that the length of the passage between the regions where the discharge voltage is applied be substantially greater than the diametric distance between opposite sides of the passage). Tungsten electrodes 43 and 44 are responsive to 3 kJ of electric energy, at 15 kV, as supplied by capacitive high voltage source 45. In this configuration, approximately $10^{-3}$ cm of $CH_2$ of material is ablated from the inner wall of dielectric sleeve 41 each time the high voltage from source 45 is applied across electrodes 43 and 44. Thereby, after approximately 50 applications of the high voltage to opposite ends of sleeve 41, the capillary, i.e., inner, diameter of sleeve 41 increases appreciably, whereby a new dielectric sleeve must replace the previously utilized sleeve, to provide additional fuel. Alternatively, a liquid surface layer could be injected along or through the wall of tube 33 to provide the ablating plasma source in the tube.

To generate plasma jets suitable for acceleration of projectile 12 to the required range, relatively small currents of a few tens of kiloamperes up to hundreds of kiloamperes are supplied by high voltage source 45 to electrodes 43 and 44. This relatively low current can achieve the desired jet pressure and therefore velocity of projectile 12 because the plasma flowing through duct 50 is decoupled from bore 31 through which projectile 12 accelerates.

To synchronize the pulsed jets supplied by tubes 33 and 34 through orifices 35 and 36 with the translation of projectile 12 through bore 31 so that the in line additive components of the pulsed jets combine at the correct position behind the projectile, the projectile position is sensed by detectors 46, one of which is in each section positioned downstream of region 32. Detector 46 is preferably a magnetic induction detector, responsive to an electrically conducting material located in or forming projectile 12 passing in bore 31 past the detector. However, it is to be understood that other detector types, such as capacitive or optical including light sources and photo cells, could be employed.

Each pulse derived by detector 46 is applied to switch 47 of a downstream stage. Switch 47 has terminals respectively connected between one electrode of high voltage supply 45 and electrode 43. The pulse of detector 46 causes momentary closure of switch 47 for an interval long enough to establish a plasma discharge between electrodes 43 and 44, along the walls of dielectric sleeves 41 and 42. Detector 46 is positioned behind orifices 35 and 36 and region 32 by a sufficient distance to enable switch 47 to be closed and the capacitor in high voltage supply 45 to be discharged across sleeves 41 and 42 and to enable the plasma in tubes 33 and 34 to propagate through orifices 35 and 36 to additively combine and accelerate projectile 12. If necessary, delay network 48 is connected between detector 46 and an actuator for switch 47, to control the time when the pulsed plasma jets are supplied through orifices 35 and 36 to bore 31.

In upstream stage 21, bore 31 has a diameter equal to the diameter of projectile 12 so the projectile contacts the walls of the bore as it is accelerated into the section and out of the section at a speed less than about 15 km/sec. Thereby the high speed plasma gases are confined behind projectile 12 as the projectile is accelerated through stage 21 to the next downstream section. When the projectile speed reaches the range of about 5 to 15 km/sec., it is accelerated to free flight, a result achieved by slightly increasing the diameter of bore 31 in intermediate stage 22 downstream of region 32 and throughout the length of downstream stage 23.

Because projectile 12 has a diameter slightly less than the diameter of bore 31 in intermediate and downstream stages 22 and 23, the plasma acting against the rear surface of the projectile has a tendency to leak around and in front of the projectile. Leaking gases in front of projectile 12 can adversely affect the performance of stages 22 and 23 because such gases if allowed to accumulate have a tendency to decelerate the projectile. To remove the plasma that has leaked around projectile 12, the portion of wall 51 (which forms bore 31) ahead of orifices 35 and 36 in stages 22 and 23 inludes apertures 52 which vent the high pressure, high velocity gases in bore 31 to the vacuum in chamber 13. Vent apertures 52 in wall 51 can be formed as circular or elongated slots; in each apertured stage the apertures have a combined area equal approximately to twice the cross-sectional area of bore 31. Vents 52 are located in a portion of wall 51 which can be considered as a drift section, downstream of main interaction region 32, between the pulsed plasma jets propagating through apertures 35 and 36 and upstream of the orifices for the following, cascaded stage of section 15.

Reference is now to made to FIG. 2 of the drawing, a cross-sectional view of one stage of intermediate section 15, in accordance with a second embodiment. In the second embodiment plasma jet streams are derived from asymmetrically located jet nozzle means for producing asymmetric force components transverse to the axis of bore 31. The asymmetric force components are produced at the location where the jet stream enters the confined path. To provide in line additive components behind projectile 12, the firing time of the plasma is controlled so that the projectile is substantially downstream of the jet nozzle when the jet enters the confined path. Thereby, the transverse components do not act against the projectile to any substantial extent. In line components of the jet stream are additive behind the projectile to accelerate it along the bore axis. The asymmetric relation facilitates changing of the plasma sources, enabling them all to be located on a single side of the assembly.

To these ends, the section illustrated in FIG. 2 includes a metal, refractory barrel 61 having a longitudinal axis along which projectile 12 travels. On one side of the wall of barrel 61 is nozzle 62 at the end of passage 63, having a longitudinal axis displaced by an acute angle from the longitudinal axis of barrel 61. Passage 63 includes an enlarged, flared end portion 64 and an elongated, small diameter, capillary portion 65, both located in assembly 70 that is selectively inserted into and removed from stub 73, integral with barrel 61. Wall 166 between end portion 64 and capillary portion 65 has a smooth transition so the plasma flows evenly out of capillary portion 65, enabling all segments of the plasma jet flowing into barrel 61 through nozzle 62 to have substantially uniform speed and temperature.

In capillary portion 65 is polyethylene tube 66, the plasma source for the supersonic plasma jet that flows from end portion 64 through nozzle 62 into the bore of barrel 61. Polyethylene tube 66 has an exterior wall that abuts against a wall of a longitudinal bore of dielectric sleeve 67.

Opposite ends of polyethylene tube 66 are electrically connected to metal, cylindrical cathode 69 and to anode 71, preferably fabricated from a refractory metal. Anode 71 includes wall transition 166 and thereby functions as a nozzle for deriving the supersonic plasma jet stream flowing from capillary passage portion 65. A portion of anode 71 includes metal cylindrical portion 72, which can be integral with the nozzle end of the electrode or can be suitably mechanically connected to the nozzle end. Cathode 69 plugs the bore of dielectric sleeve 67 to assist in holding polyethylene sleeve 66 in place, and prevent the escape of plasma gases from the end of capillary passage portion 65 opposite from nozzle end portion 64.

Polyethylene tube 66 is also held in place by a shoulder on dielectric sleeve 67 at the intersection of tube 66, sleeve 67 and cathode 69. Polyethylene tube 66, dielectric sleeve 67 and all segments of electrodes 69 and 71 are coaxial with the axis of passage 63. To enable assembly 70, including tube 66, sleeve 67, and electrodes 69 and 71, to be easily inserted into and withdrawn from one side of barrel 61, the barrel includes an oblique, annular stub 73, having a threaded, cylindrical bore into which electrode 71 is screwed. This arrangement facilitates insertion and removal of assembly 70, a desirable feature to facilitate insertion of a new polyethylene tube 66 or an entire assembly in the event that any component in the assembly breaks.

To control ignition of plasma from polyethylene tube 66, a voltage is applied between electrodes 69 and 71 at opposite ends of the tube. To these ends, detector 46 is mounted on the exterior of barrel 61 upstream of nozzle 62. Detector 46 supplies a signal to switch 47 via delay circuit 48 to apply the high voltage of source 45 between electrodes 69 and 71, as described supra, in connection with FIG. 1.

However, the time when voltage is applied between electrodes 69 and 71, to derive the supersonic plasma jet flowing through nozzle 62, differs in the FIG. 2 embodiment from that in the FIG. 1 embodiment. In the FIG. 1 embodiment, the plasma firing is timed so that the supersonic plasma jet enters bore 31 just as projectile 12 is leaving region 32. In the FIG. 1 embodiment, such timing is possible because of the symmetrical nature of the plural jet pulses applied to bore 31 at a particular location along the bore.

In the embodiment of FIG. 2, however, the transverse force components of the supersonic plasma jet flowing through nozzle 62 into the bore of barrel 61 are asymmetrical. If the asymmetrical force components immediately act on projectile 12, the projectile would have a tendency to be urged against the wall of barrel 61 opposite from nozzle 62. To avoid such a tendency, delay circuit 48 is adjusted so that plasma is fired from polyethylene tube 66 at a time such that the supersonic plasma jet flows through nozzle 62 when projectile 12 is somewhat downstream of the nozzle, whereby only axial components of the supersonic plasma jet are applied to the rear of projectile 12. The in line components applied to the rear of projectile 12 are applied equally across the rear surface of the projectile, so that the embodiment of FIG. 2 is applicable to the low velocity situation, wherein projectile 12 engages the wall of metal barrel 61, as well as to the high velocity situation wherein projectile 12 is in free flight between the walls of the barrel.

Downstream of nozzle 62 and the point along barrel 61 where the supersonic plasma jet flowing through the nozzle initially acts against the rear of projectile 12 to accelerate the projectile, gas is vented from the bore of barrel 61. To these ends, apertures 74 are provided in the wall of barrel 61. Gas in the plasma jet in the bore of barrel 61 flows through apertures 74 into vacuum chamber 75, which surrounds the exterior wall of barrel 61. Chamber 75 is connected to a suitable vacuum source (not shown) to provide the same results described supra, in connection with vents 52, FIG. 1.

While there have been described and illustrated several specific embodiments of the invention, it will be clear that variations in the details of the embodiments specifically illustrated and described may be made without departing from the true spirit of the invention as defined in the appended claims.

We claim:

1. Apparatus for accelerating a projectile comprising means forming a confined path having a longitudinal axis along which the projectile traverses, and means for supplying a pulsed high pressure, high velocity plasma jet to the path from outside the path and to the rear of the projectile as the projectile traverses the path to accelerate the projectile along the path, the jet entering the confined path at a non-zero acute angle relative to the confined path axis, the projectile and confined path geometries being such that the plasma to the rear of the projectile has a tendency to leak around the projectile so the leaked plasma is in front of the projectile, the plasma in front of the projectile tending to accumulate and to impede the acceleration of the projectile, and means for venting the plasma in front of the projectile from the confined path to substantially overcome the tendency of the leaked plasma to accumulate and impede the projectile acceleration.

2. The apparatus of claim 1 wherein the means for venting the plasma in front of the projectile from the confined path includes a vacuum chamber surrounding a wall defining the confined path, said chamber having openings into the confined path at several locations around the wall.

3. Apparatus for accelerating a projectile comprising means forming a confined path having a longitudinal axis along which the projectile traverses, and means for supplying a pulsed high pressure, high velocity plasma jet to the path from outside the path and to the rear of the projectile as the projectile traverses the path to accelerate the projectile along the path, the jet entering the confined path at a non-zero acute angle relative to the confined path axis, the means for supplying a pulsed high pressure, high velocity plasma jet to the path including a tube having an interior wall forming a capillary passage, means for applying a discharge voltage between spaced regions along the length of the interior wall while a dielectric ionizable substance is between the regions, the dielectric substance including at least one element that is ionized to form a plasma in response to the discharge voltage being applied between the spaced regions, the diametric length across the passage being short relative to the distance between the spaced regions, first and second ends of the passage being respectively open and blocked while the discharge voltage is applied between the spaced regions to respectively enable and prevent the flow of plasma through them, the plasma forming an electric discharge channel between the spaced regions while the discharge voltage is applied between the regions, ohmic dissipation occurring in the electric discharge channel in response to the discharge voltage being applied between the regions to produce a high pressure in the passage to cause the plasma in the passage to flow longitudinally in the passage and through the first end to form the pulsed plasma jet.

4. The apparatus of claim 3 wherein the interior wall is solid and includes the dielectric ionizable substance and the element is ablated and ionized from the solid to form the plasma.

5. The structure of claim 3 wherein the voltage applying means includes a first electrode forming the first end and a second electrode plugging the second end while the discharge is occurring.

6. Apparatus for accelerating a projectile comprising means forming a confined path having a longitudinal axis along which the projectile traverses, and means for supplying a pulsed high pressure, high velocity plasma jet to the path from outside the path and to the rear of the projectile as the projectile traverses the path to accelerate the projectile along the path, the jet entering the confined path at a non-zero acute angle relative to the confined path axis, a plurality of the supplying means being located at spaced longitudinal regions along the path, and means for synchronizing the activation of the jets at each of the spaced regions so that at each of the longitudinal regions a pulse of the high pressure, high velocity plasma is applied to the rear of the projectile immediately after the projectile has traversed each of the longitudinal regions, the projectile and confined path geometries being such that the high velocity plasma applied to the rear of the projectile leaks around the projectile so some of the plasma is in front of the projectile to tend to impede acceleration of the projectile in the path, and means between at least some of said spaced longitudinal regions for venting the plasma leaking around the projectile from the confined path.

7. The apparatus of claim 6 wherein the means for venting includes perforations in the confined path, the perforations between each adjacent pair of longitudinal regions having an area approximately twice the cross sectional area of the interior of the confined path.

8. The apparatus of claim 6 wherein the confined path has a circular interior cross section and the projectile is shaped as a surface of revolution having a maximum diameter slightly less than the diameter of the circular interior cross section, the means for venting including perforations in the confined path, the perforations between each adjacent pair of longitudinal regions having an area approximately twice the cross sectional area of the interior of the confined path.

9. Apparatus for accelerating a projectile comprising means forming a confined path having a longitudinal axis along which the projectile traverses, means for accelerating the projectile from rest in the path, a plurality of cascaded intermediate velocity stages for accelerating the projectile from non-free to free flight in the path downstream of the means for accelerating from rest, a plurality of cascaded high velocity stages for accelerating the projectile in the path downstream of the plural intermediate stages, each of the intermediate stages including means for applying a pulsed plasma jet to the rear of the projectile, each of the high velocity stages including means for supplying plasma to the sides of the projectile as the projectile traverses the particular high velocity stage.

10. The apparatus of claim 9 wherein the pulsed plasma jet applying means of each intermediate stage includes means for supplying the jet to the path from outside the path, the jet entering the confined path at a non-zero acute angle relative to the axis.

11. The apparatus of claim 10 wherein the means for supplying the jet from outside the path includes a capillary tube having a longitudinal axis displaced from the confined path axis by said angle, the tube having an inner wall including a dielectric ionizable substance, and means for applying a voltage between spaced points along the tube longitudinal axis to the substance so that the substance is ionized to form the plasma inside of the tube, the tube being dimensioned so that the plasma formed therein has a high velocity and high pressure to form each of the jets, the tube having a closed first end while the voltage is applied between the spaced points and a second end having an orifice into the confined path, the tube longitudinal axis being displaced from the confined path by said angle so that the jet associated with the supplying means propagates along the longitudinal axis of the tube and through the orifice into the confined path generally in the same direction as the projectile is being accelerated.

12. Apparatus for accelerating a projectile comprising means forming a confined path having a longitudinal axis along which the projectile traverses, and means for supplying a pulsed high pressure, high velocity plasma jet to the path from outside the path and to the rear of the projectile as the projectile traverses the path to accelerate the projectile along the path, the jet entering the confined path at a non-zero acute angle relative to the confined path axis, the means for supplying comprising a tube having a longitudinal axis displaced from the confined path axis by the acute angle, the tube having an inner diameter including a dielectric ionizable substance, and means for applying a discharge voltage to the substance between displaced regions along the tube longitudinal axis to cause the substance to be ionized to form the plasma inside of the tube, the tube being dimensioned so that the plasma formed therein in response to the discharge voltage has a high velocity and high pressure to form the jet, the tube having a closed first end while the plasma is formed therein and a second end including an orifice into the confined path, the tube longitudinal axis being displaced from the confined path by said angle so that the jet propagates along the longitudinal axis of the tube and through the orifice into the confined path generally in the same direction as the projectile is being accelerated.

13. The apparatus of claim 12 wherein the angle is approximately 15°.

14. The apparatus of claim 12 wherein the substance is a solid that is ablated to form the plasma in response to the substance being ionized.

15. The apparatus of claim 14 wherein the ionizable substance includes a hydrogen rich, carbon hydrogen composition, the hydrogen and carbon in the composition being ionized in response to the applied voltage to form the plasma.

16. A method of accelerating a projectile along a confined path having a longitudinal axis along which the projectile traverses, comprising supplying a pulse of high pressure, high velocity plasma to the path behind the projectile as the projectile traverses the path by supplying a jet of the plasma to the confined path from a source located outside of the confined path so the plasma enters the path at a non-zero acute angle relative to the axis, the jet being derived by applying an electric discharge between spaced regions along a longitudinal axis of a capillary passage, blocking one end of said passage while the discharge is occurring, an electric discharge channel being formed by the plasma in the passage between the spaced regions in response to the applied electric discharge, ohmic dissipation occurring in the electric discharge channel in response to the applied electric discharge to produce a high pressure in the passage to cause plasma to flow longitudinally in the passage and through an orifice in an end of the passage opposite from the blocked one end, the plasma flowing through the orifice into the confined path to form the jet.

17. The method of claim 16 further including accelerating the jet while it is in the passage to several times the sound speed of plasma in the jet so that the jet has a velocity in the confined path of approximately twice the projectile velocity while the jet acts against the rear of the projectile.

18. The method of claim 16 further including expanding and cooling the jet as it enters the confined path.

19. The method of claim 18 further including supplying additional material to the passage to replace plasma supplied by the passage to the confined path while the plasma is ejected from the passage into the confined path, and bombarding a wall of the passage with radiation from the plasma.

20. The method of claim 16 wherein the jet is derived by ablating material from an interior dielectric tube wall forming the passage in response to the applied electric discharge.

21. The method of claim 20 further including ablating additional material from the wall to replace plasma ejected from the wall into the confined path while the plasma is ejected from the wall into the confined path, and bombarding the wall with radiation from the plasma.

22. The method of claim 16 wherein the plasma pulse is supplied to the rear of the projectile to impart kinetic energy to the projectile to accelerate the projectile along the path.

23. The method of claim 22 wherein N of the plasma jets are simultaneously supplied to a common longitudinal location of the path, where N is an integer greater than 1, each of said jets having substantially the same pressure and velocity, the in line additive force components of the plasma jets combining behind the projectile in the confined path to accelerate the projectile.

24. Apparatus for accelerating a projectile comprising means forming a confined path having a longitudinal axis along which the projectile traverses, and means for supplying a pulsed high pressure, high velocity plasma jet to the path from outside the path and to the rear of the projectile as the projectile traverses the path to accelerate the projectile along the path, the jet entering the confined path at a non-zero acute angle relative to the confined path axis, the supplying means including a capillary passage having a longitudinal axis, said passage having one closed end and an orifice at the other end into the confined path, means for applying a discharge voltage between spaced longitudinal regions of the passage in the direction of the passage longitudinal axis to form a plasma in the passage, an electric discharge channel being formed by the plasma in the passage between the spaced passage regions while the discharge voltage is applied between the spaced regions, said one end being closed while the discharge is occurring, ohmic dissipation occurring in the electric discharge channel while the discharge voltage is applied between the spaced regions to produce a high pressure in the passage to cause plasma to flow longitudinally in the passage and through the orifice to form the jet that enters the confined path.

25. The apparatus of claim 24 wherein the supplying means includes a tube having an interior dielectric wall forming the capillary passage, the wall containing plasma forming material which is ablated in response to the discharge voltage being applied between the spaced regions.

26. The apparatus of claim 24 wherein the confined path and capillary passage are in a vaccum.

27. The apparatus of claim 24 wherein said supplying means includes means for supplying at least one longitudinally propagating plasma jet stream to a longitudinal location of the path, said at least one plasma jet stream having force components in line with the confined path axis when the jet stream is behind the projectile, the in line additive components combining behind the projectile in the confined path to accelerate the projectile.

28. The apparatus of claim 24 wherein said supplying means includes means for simultaneously supplying N longitudinally propagating plasma streams to a common longitudinal location of the path, where N is an integer greater than 1, each of said plasma jet streams having substantially the same pressure and velocity as well as a common angular displacement in the direction of the longitudinal propagation thereof from the axis of the confined path and being symmetrically disposed relative to the axis of the confined path so that transverse force components of the plasma jet streams relative to the axis are substantially cancelled and force components in line with the axis that are additive when the plasma jet streams combine behind the projectile, the in line additive components combining behind the projectile in the confined path to accelerate the projectile.

29. The apparatus of claim 24 wherein said supplying means includes means for supplying a longitudinally propagating plasma stream to a particular longitudinal location of the path via asymmetrically located nozzle means for producing asymmetric force components transverse to the axis at the particular location where the jet stream enters the path in response to the jet stream, the jet stream being timed so that it enters the path at a time when the projectile is downstream of the nozzle means, the plasma stream flowing through the nozzle means having in line and transverse components relative to the axis of the path, the in line components adding to combine behind the projectile in the confined path to accelerate the projectile, the projectile location at the time the plasma stream enters the path being such that transverse components are not applied by the plasma to the projectile.

30. The apparatus of claim 24 wherein the confined path is configured and the jet is oriented to enter the confined path so that the jet supplies kinetic energy to the rear of the projectile to accelerate the projectile along the path.

31. The apparatus of claim 24 wherein the confined path has a circular interior cross section and the projectile is shaped as a surface of revolution having a maximum diameter slightly less than the diameter of the circular interior cross section.

32. The apparatus of claim 24 wherein the capillary passage includes an outwardly flared nozzle through which the jet is injected into the confined path so the jet expands and cools as it enters the confined path.

33. The apparatus of claim 24 wherein the confined path has a cross-sectional area considerably greater than the cross-sectional area of the capillary passage so the jet expands and cools as it enters the confined path.

34. The apparatus of claim 33 wherein the capillary passage includes an outwardly flared nozzle through which the jet is injected into the confined path so the jet expands and cools as it enters the confined path.

35. The apparatus of claim 24 wherein a plurality of the supplying means are located at spaced longitudinal regions along the path, and means for synchronizing the activation of the jets at each of the spaced regions so that at each of the longitudinal regions a pulse of the high pressure, high velocity plasma is applied to the rear of the projectile after the projectile has traversed that longitudinal region.

36. The apparatus of claim 35 wherein said means for synchronizing includes means for detecting movement of the projectile at a point upstream of one of said regions, and means responsive to the detecting means signalling movement of the projectile through the point for activating a jet applied to one of the regions downstream of the point.

37. The apparatus of claim 24 wherein a plurality of said supplying means are located at spaced longitudinal regions along the path, and means for activating the jets at a plurality of the spaced regions so that at each of the plural spaced longitudinal regions a pulse of the high pressure, high velocity plasma is applied to the rear of the projectile immediately after the projectile has traversed each of the longitudinal regions.

38. The apparatus of claim 37 wherein the means for activating at at least some of the plural spaced regions includes means for detecting movement of the projectile at a point upstream of each of said at least some regions, and means responsive to the detecting means signalling movement of the projectile through the points for activating the jets applied to the regions downstream of the points, the geometry of the projectile and confined path being such that plasma has a tendency to leak around the projectile so some of the plasma is in front of the projectile, the plasma in front of the projectile tending to accumulate and to impede the acceleration of the projectile, and means between said at least some of the spaced longitudinal regions and the points for detecting movement immediately downstream of each longitudinal region for venting the plasma in front of the projectile from the confined path.

39. The apparatus of claim 9 wherein each of the means for applying a pulsed plasma jet to the rear of the projectile includes means for supplying at least one longitudinally propagating plasma stream to a longitudinal location of the path, said at least one plasma jet stream having force components in line with the axis when the jet stream is behind the projectile in the confined path to accelerate the projectile.

40. The apparatus of claim 9 wherein each of the means for applying a pulsed plasma jet to the rear of the projectile includes means for simultaneously supplying N longitudinal plasma jets to a common longitudinal location of the path, where N is an integer greater than 1, each of said plasma jets having substantially the same pressure and velocity as well as a common angular displacement in the direction of the longitudinal propagation thereof from the axis of the confined path and being symmetrically disposed relative to the axis of the confined path so that transverse force components of the plasma jet streams relative to the axis are substantially cancelled and force components of the plasma jet streams combine behind the projectile, the in line additive components combining behind the projectile in the confined path to accelerate the projectile.

41. The apparatus of claim 9 wherein each of the means for applying a pulsed plasma jet to the rear of the projectile includes means for supplying at least one longitudinally propagating plasma stream to a longitudinal location of the path, said at least one plasma jet stream having force components in line with the axis when the jet stream is behind the projectile in the confined path to accelerate the projectile.

* * * * *